US008324600B2

(12) United States Patent
Hayashi et al.

(10) Patent No.: US 8,324,600 B2
(45) Date of Patent: Dec. 4, 2012

(54) APPARATUS AND METHOD FOR MEASURING AND CONTROLLING TARGET TRAJECTORY IN CHAMBER APPARATUS

(75) Inventors: Hideyuki Hayashi, Hiratsuka (JP); Tooru Abe, Hiratsuka (JP); Kouji Kakizaki, Hiratsuka (JP); Toshihiro Nishisaka, Hiratsuka (JP)

(73) Assignee: Gigaphoton Inc., Tochigi (JP)

( * ) Notice: Subject to any disclaimer, the term of this patent is extended or adjusted under 35 U.S.C. 154(b) by 46 days.

(21) Appl. No.: 12/783,219

(22) Filed: May 19, 2010

(65) Prior Publication Data

US 2010/0294958 A1 Nov. 25, 2010

(30) Foreign Application Priority Data

May 21, 2009 (JP) ..... 2009-122647

(51) Int. Cl.
*H05G 2/00* (2006.01)
*G21G 4/00* (2006.01)

(52) U.S. Cl. ..... 250/504 R; 355/67; 250/493.1

(58) Field of Classification Search .... 250/493.1–503.1, 250/504 R; 355/66–71
See application file for complete search history.

(56) References Cited

U.S. PATENT DOCUMENTS 7,361,918 B2 * 4/2008 Akins et al. ..... 250/504 R
7,718,985 B1 * 5/2010 Bernath et al. ..... 250/573
2007/0001130 A1 * 1/2007 Bykanov et al. ..... 250/493.1
2007/0170377 A1 * 7/2007 Nakano ..... 250/504 R

FOREIGN PATENT DOCUMENTS

WO WO 2005/091879 A2 10/2005

* cited by examiner

*Primary Examiner* — Robert Kim
*Assistant Examiner* — David E Smith
(74) *Attorney, Agent, or Firm* — McDermott Will & Emery LLP

(57) ABSTRACT

An apparatus for measuring and controlling a target trajectory within a chamber apparatus for generating extreme ultraviolet light from plasma generated by irradiating a droplet target supplied from a target injection nozzle with a driver laser beam from an external driver laser. The apparatus includes: a nozzle adjustment mechanism for adjusting at least one of a position and an angle of the target injection nozzle; a target trajectory measuring unit for measuring a target trajectory to obtain trajectory information on the target trajectory; a target trajectory angle detecting unit for obtaining a value related to an angle deviation between the target trajectory represented by the trajectory information and a predetermined target trajectory; and a nozzle adjustment controller for controlling the nozzle adjustment mechanism based on the value related to the angle deviation such that the droplet target passes through a predetermined laser beam irradiation position.

17 Claims, 11 Drawing Sheets

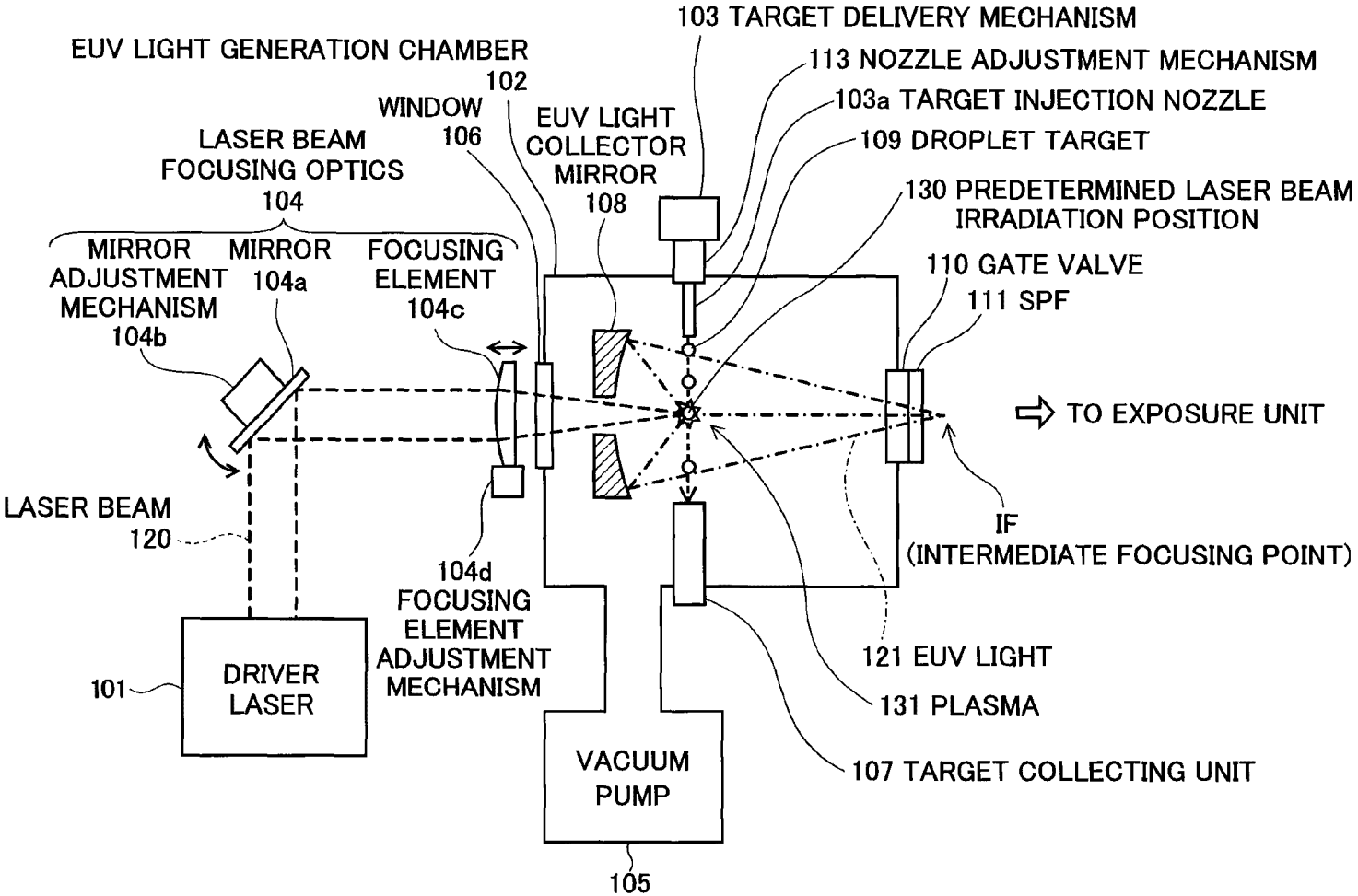
FIG.1
103 TARGET DELIVERY MECHANISM
113 NOZZLE ADJUSTMENT MECHANISM
103a TARGET INJECTION NOZZLE
109 DROPLET TARGET
130 PREDETERMINED LASER BEAM IRRADIATION POSITION
110 GATE VALVE
111 SPF
TO EXPOSURE UNIT
IF (INTERMEDIATE FOCUSING POINT)
121 EUV LIGHT
131 PLASMA
107 TARGET COLLECTING UNIT
EUV LIGHT COLLECTOR MIRROR 108
VACUUM PUMP
105
EUV LIGHT GENERATION CHAMBER 102
WINDOW 106
LASER BEAM FOCUSING OPTICS 104
MIRROR ADJUSTMENT MECHANISM 104b
MIRROR 104a
FOCUSING ELEMENT 104c
104d FOCUSING ELEMENT ADJUSTMENT MECHANISM
LASER BEAM 120
DRIVER LASER
101

APPARATUS AND METHOD FOR MEASURING AND CONTROLLING TARGET TRAJECTORY IN CHAMBER APPARATUS

CROSS-REFERENCE TO RELATED APPLICATION

The present application claims priority from Japanese Patent Application No. 2009-122647 filed on May 21, 2009, the contents of which are incorporated herein by reference in their entirety.

BACKGROUND OF THE INVENTION

1. Field of the Invention

The present invention relates to an apparatus and a method for measuring and controlling a trajectory (track) of a droplet target to be used for generating plasma radiating EUV (extreme ultraviolet) light in a chamber apparatus of an LPP (laser produced plasma) type EUV light source apparatus for generating EUV light to be used for exposure of semiconductor wafers or the like.

2. Description of a Related Art

In recent years, as semiconductor processes become finer, photolithography has been making rapid progress toward finer fabrication. In the next generation, microfabrication at 60 nm to 45 nm, further, microfabrication at 32 nm and beyond will be required. Accordingly, in order to fulfill the requirement for microfabrication at 32 nm and beyond, for example, exposure equipment is expected to be developed by combining an EUV light source for generating EUV light having a wavelength of about 13 nm and reduced projection reflective optics.

As the EUV light source, there are three kinds of light sources, which include an LPP (laser produced plasma) light source using plasma generated by irradiating a target with a laser beam, a DPP (discharge produced plasma) light source using plasma generated by discharge, and an SR (synchrotron radiation) light source using orbital radiation. Among them, the LPP light source has advantages that extremely high intensity close to black body radiation can be obtained because plasma density can be considerably made larger, and that the light of only the particular waveband can be radiated by selecting the target material. Further, the LPP light source has advantages that an extremely large collection solid angle of $2\pi$ to $4\pi$ steradian can be ensured because it is a point light source having substantially isotropic angle distribution and there is no structure such as electrodes surrounding the plasma light source and so on. Therefore, the LPP light source is considered to be predominant as a light source for EUV lithography, which requires power of more than several tens of watts.

Here, a principle of generating EUV light in the LPP light source will be explained. A target material supplied into a chamber is irradiated with a driver laser beam, and thereby, the target material is excited and turned into plasma. From the plasma, various wavelength components including EUV light are radiated. Then, EUV light is reflected and collected by using an EUV collector mirror for highly reflecting a specific wavelength component (for example, a component having a wavelength of 13.5 nm), and outputted to a device using EUV light (for example, exposure unit). For the purpose, on a reflection surface of the EUV collector mirror, for example, a multilayer coating (Mo/Si multilayer coating) in which molybdenum (Mo) thin coatings and silicon (Si) thin coatings are alternately stacked is formed.

In the LPP light source, as the target material to be used for generating plasma radiating EUV light, liquid tin is considered to be a predominant material. Accordingly, in the LPP light source, a target delivery mechanism is provided for injecting tin melted at a high temperature from a target injection nozzle and supplying it in a droplet state to a predetermined plasma generation position. Here, the predetermined plasma generation position is a position on which a pulse laser beam is focused by using a laser beam focusing optics, and, when the target material passing through the position is irradiated with the pulse laser beam, plasma is generated.

SUMMARY

According to one aspect of the present invention, there is provided an apparatus for measuring and controlling a target trajectory within a chamber apparatus for generating extreme ultraviolet light from plasma generated by irradiating a droplet target supplied from a target injection nozzle with a driver laser beam from an external driver laser, and the apparatus includes: a nozzle adjustment mechanism for adjusting at least one of a position and an angle of the target injection nozzle; a target trajectory measuring unit for measuring a target trajectory formed by a droplet target supplied from the target injection nozzle to obtain trajectory information on the target trajectory; a target trajectory angle detecting unit for obtaining a value related to an angle deviation between the target trajectory represented by the trajectory information obtained by the target trajectory measuring unit and a predetermined target trajectory; and a nozzle adjustment controller for controlling the nozzle adjustment mechanism based on the value related to the angle deviation obtained by the target trajectory angle detecting unit such that the droplet target passes through a predetermined position.

Further, according to another aspect of the present invention, there is provided a method of measuring and controlling a target trajectory within a chamber apparatus for generating extreme ultraviolet light from plasma generated by irradiating a droplet target supplied from a target injection nozzle with a driver laser beam from an external driver laser, and the method includes the steps of: (a) measuring a target trajectory formed by a droplet target supplied from the target injection nozzle to obtain trajectory information on the target trajectory; (b) obtaining a value related to an angle deviation between the target trajectory represented by the trajectory information obtained at step (a) and a predetermined target trajectory; and (c) adjusting at least one of a position and an angle of the target injection nozzle based on the value related to the angle deviation obtained at step (b) such that the droplet target passes through a predetermined position.

BRIEF DESCRIPTION OF THE DRAWINGS

FIG. 1 is a schematic diagram showing an outline of an extreme ultraviolet light source apparatus to which an apparatus for measuring and controlling a target trajectory according to one embodiment of the present invention is applied;

DETAILED DESCRIPTION

Figure 2:
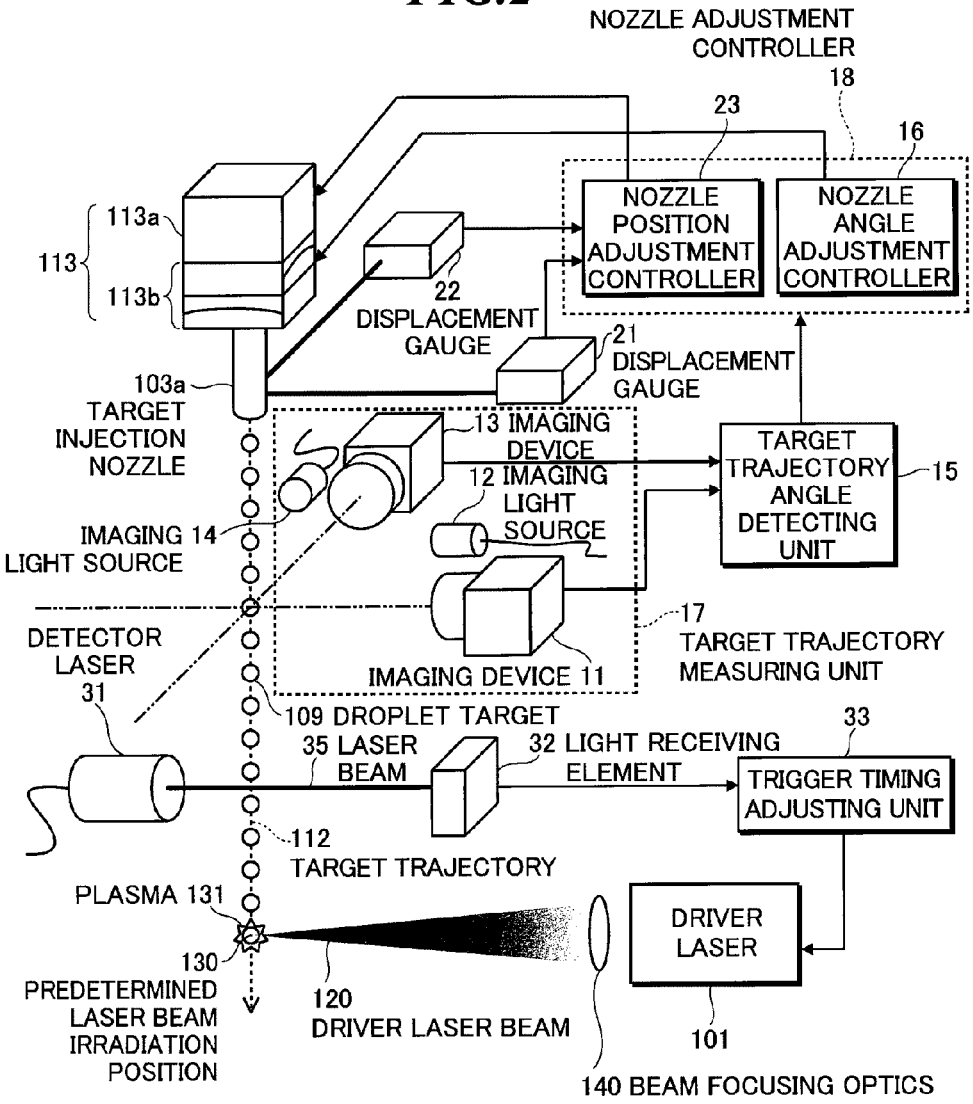
FIG. 2 is a block diagram showing a configuration example of the apparatus for measuring and controlling a target trajectory according to the one embodiment of the present invention.

Hereinafter, embodiments of the present invention will be explained in detail by referring to the drawings. The same reference numerals are assigned to the same component elements and the duplicated explanation thereof will be omitted.

FIG. 1 is a schematic diagram showing an outline of an extreme ultraviolet light source apparatus to which an apparatus for measuring and controlling a target trajectory according to one embodiment of the present invention is applied. As shown in FIG. 1, the LPP light source includes a driver laser 101, an EUV light generation chamber (chamber apparatus) 102, a target delivery mechanism 103 incidental to the EUV light generation chamber 102, and a laser beam focusing optics 104 as main component elements. Further, in the EUV light generation chamber 102, a nozzle adjustment mechanism 113 as a part of the apparatus for measuring and controlling a target trajectory, which will be explained later, is provided. The apparatus for measuring and controlling a target trajectory may be a single apparatus for performing both measurement and control of the target trajectory (track), or may be an apparatus including an apparatus for measuring a target trajectory and an apparatus for controlling a target trajectory which apparatuses are connected to each other via a communication line.

The driver laser 101 is a high-power laser apparatus such as a carbon dioxide laser for generating a driver laser beam (pulsed laser beam) to be used for turning the target material into plasma.

The EUV light generation chamber 102 is a chamber in which EUV light is generated. The EUV light generation chamber 102 is evacuated by a vacuum pump 105 for prevention of absorption of EUV light. Further, in the EUV light generation chamber 102, a window 106 for introducing a laser beam 120 generated from the driver laser 101 into the EUV light generation chamber 102 is attached. Furthermore, within the EUV light generation chamber 102, a target injection nozzle 103*a* as a part of the target delivery mechanism 103, a target collecting unit 107, and an EUV light collector mirror 108 are provided.

The target delivery mechanism 103 supplies the target material to be used for generating EUV light into the EUV light generation chamber 102 via the target injection nozzle 103*a*. As a target material, a molten metal of tin (Sn), lithium (Li), or the like may be used. The target delivery mechanism 103 melts the metal and pressurizes it with an inert gas such as argon (Ar), and thereby, ejects the molten metal through a minute hole of about several tens of micrometers of the target injection nozzle 103*a*.

The molten metal ejected from the minute hole may be formed into droplets having a uniform size at a certain distance from the target injection nozzle 103*a* by providing periodic vibration to the target injection nozzle 103*a* by using a piezoelectric element or the like. The produced droplet target 109 is irradiated with a laser beam when it passes through a predetermined laser beam irradiation position 130, and a part of it turns into plasma 131 generating light having various wavelength components including EUV light. Among the supplied droplet targets 109, the targets that have not been turned into plasma may be collected by the target collecting unit 107.

The laser beam focusing optics 104 may include a mirror 104*a* for reflecting the laser beam 120 outputted from the driver laser 101 in a direction of the EUV light generation chamber 102, a mirror adjustment mechanism 104*b* for adjusting the position and the angle (elevation angle) of the mirror 104*a*, a focusing element 104*c* for focusing the laser beam 120 reflected by the mirror 104*a*, and a focusing element adjustment mechanism 104*d* for moving the focusing element 104*c* along the optical axis of the laser beam. The laser beam 120 focused by the laser beam focusing optics 104 may pass through the window 106 and the opening formed at the center of the EUV light collector mirror 108 to reach the trajectory of the droplet target 109. The laser beam focusing optics 104 focuses the laser beam 120 to form a focus on the trajectory of the droplet target 109. Thereby, the droplet target 109 supplied from the target injection nozzle 103*a* is excited and turned into plasma, and EUV light 121 is generated from the plasma.

The EUV light collector mirror 108 is a concave mirror having a spheroidal reflection surface on which, for example, a Mo/Si coating for reflecting light having a wavelength of 13.5 nm at high reflectance is formed. The EUV light collector mirror 108 reflects the generated EUV light 121 to collect it to an intermediate focusing point (IF). The EUV light 121 reflected by the EUV light collector mirror 108 may pass through a gate valve 110 provided in the EUV light generation chamber 102. Further, the EUV light 121 may pass through a spectral purity filter (SPF) 111 for removing unnecessary light (electromagnetic waves or light having shorter wavelengths than that of EUV light, and light having longer wavelengths than that of EUV light, for example, violet light, visible light, infrared light, and so on) from the light generated from the plasma 131, and transmitting only specific EUV light, for example, light having a wavelength of 13.5 nm. Then, the EUV light 121 collected on the IF (intermediate focusing point) may be guided to an exposure unit or the like via a transmission optics.

Here, in the case where plasma is generated from the same point as the point at which the droplet target 109 has first been irradiated with the laser beam 120, the laser beam irradiation point coincides with the plasma generation position. On the other hand, there is a method of generating EUV light by irradiating the droplet target 109 with a pre-pulse laser beam to expand it, and then, irradiating the expanded target with a main-pulse laser beam to generate plasma. In this case, the first laser beam irradiation point may not necessarily coincide with the plasma generation position. Accordingly, in this application, the position where the droplet target 109 is first irradiated with the laser beam 120 is referred to as "predetermined laser beam irradiation position".

By the way, the tin droplet target having a diameter of 10 μm to 60 μm passes through a predetermined plasma generation position at a high speed of about 30 m/s to about 60 m/s, for example. In this regard, the droplet target is irradiated with a pulsed laser beam having a repetition rate of, for example, 50 kHz to 100 kHz in a plasma generation region having a diameter of, for example, about several tens of micrometers. Therefore, in order to generate EUV light, it is necessary that the pulse timing of the pulsed laser beam and the generation timing of the droplet target are synchronized and the trajectory of the droplet target passes through the predetermined plasma generation position for stabilization of the output of the EUV light source and the plasma generation position (emission point of EUV light). The trajectory of the droplet target may vary due to various factors such as the temperature change and wear-out of the nozzle part for injecting the target material, and therefore, it is desirable to measure and control the three-dimensional spatial position thereof.

A general LPP light source control system includes an imaging device (CCD camera) for supplying an image of a target stream path as output, and a stream path error detector for detecting the position error of the target stream path imaged by the imaging device. The stream path error detector detects the position error of the target stream path. The position error of the target stream path is a position error in a direction of an axis substantially perpendicular to the target stream path from the desired target stream path intersecting the desired plasma start site (plasma generation position). Further, two imaging devices may be arranged such that the optical axes are orthogonal to each other, and perceive the two-dimensional position error.

Figure 16:
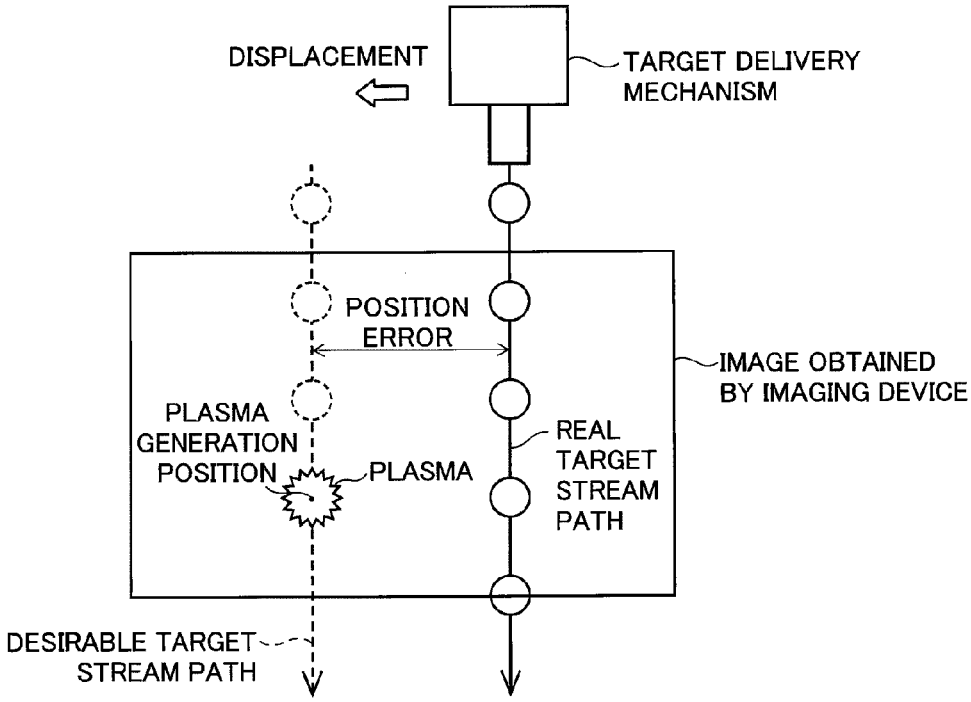
FIG.16 PRIOR ART
FIG. 16 is a conceptual diagram for explanation of an operation of a general LPP light source control system.

As shown in FIG. 16, the LPP light source control system performs control of aligning the real target stream path with the desirable target stream path by displacing the target delivery mechanism in the direction of the axis to eliminate the error of the target stream path, which is detected by the stream path error detector based on the image obtained by the imaging device, in the direction of the axis. The trajectory position of the droplet target can be controlled within a plane in a two-dimensional manner.

However, in the real operation, the radiation direction of the droplet target injected from the target injection nozzle may change and tilt relative to the predetermined injection direction. It is estimated that this is because the tip end of the target injection nozzle is corroded by heat and the channel is deflected or the solid produced by the reaction of a part of the target material, for example, tin oxide or tin compound adheres to the channel or the outer part of the target injection nozzle, and thereby, the injection direction of the droplet target is changed.

On the other hand, in the case where the plasma generation position is reflected within the image obtained by the imaging device, the brightness in the plasma generation position is extremely higher and it is difficult to accurately detect the position of the droplets having lower brightness. Therefore, the position error of the target trajectory in the predetermined plasma generation position is estimated by using the position error in the position apart from the plasma generation position, that is, the position nearer to the plasma generation position between the target injection nozzle and the plasma generation position.

Figure 17:
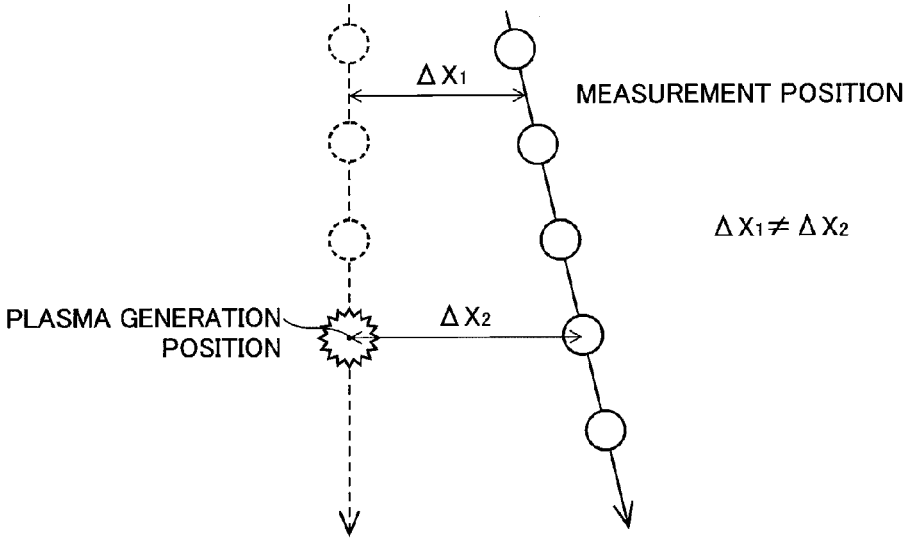
FIG.17 PRIOR ART
FIG. 17 is a conceptual diagram for explanation of a situation caused in the general LPP light source control system.

As shown in FIG. 17, in the case where the real target trajectory tilts relative to the predetermined target trajectory, the position error $\Delta X_2$ of the target trajectory in the predetermined plasma generation position is different from the position error $\Delta X_1$ of the target trajectory in the measurement position. If the position control of the target delivery mechanism is performed based on the different position error $\Delta X_1$, the droplet target is not allowed to accurately pass through the predetermined plasma generation position. As described above, it is impossible to directly measure the position error $\Delta X_2$ of the target trajectory in the predetermined plasma generation position, and the real target trajectory may tilt relative to the predetermined target trajectory.

Further, when tin is used as the target material, the molten tin is heated to nearly 300° C. in the target delivery mechanism. In this regard, the part near to the tip end of the target injection nozzle for injecting the molten tin may be thermally deformed and displaced from the designed position or the channel of the target injection nozzle may be deflected. In this case, if the configuration in which the target delivery mechanism is mounted on a linear stage or the like and moved is used, when the real target trajectory is shifted relative to the predetermined target trajectory, only a part of the target trajectory may be imaged. That may cause inaccurate evaluation of the amount of movement of the target delivery mechanism or the change of the injection direction of the droplet target.

Figure 18:
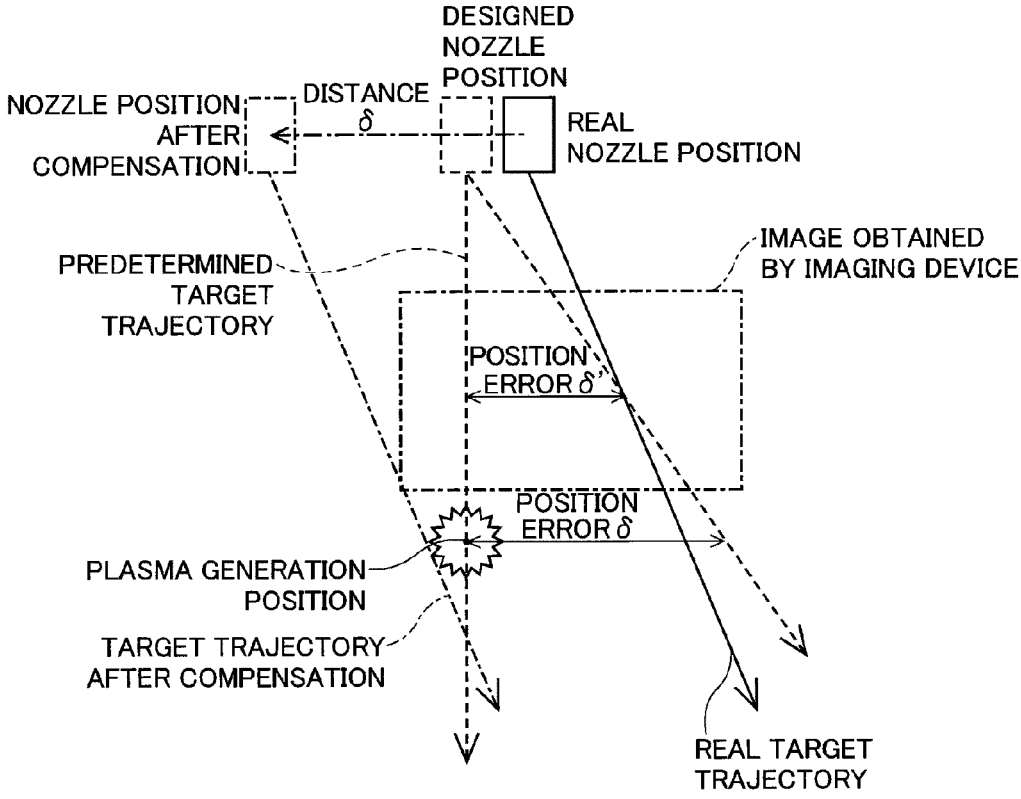
FIG.18 PRIOR ART
FIG. 18 is a conceptual diagram for explanation of another situation caused in the general LPP light source control system.

FIG. 18 is a conceptual diagram for explanation of another situation in the general LPP light source control system. In FIG. 18, the situation, in which both the position shift of the target delivery mechanism and the change of the target injection direction in the target injection nozzle occur, is shown. The designed nozzle position is located above the predetermined plasma generation position in the drawing (broken line), but the real nozzle position is shifted to the right in the drawing (solid line). Further, it is possible that the real target injection direction tilts to the right in the drawing relative to the predetermined injection direction.

Here, it is assumed that the target injection nozzle is located above the predetermined plasma generation position in the drawing (broken line). In this case, the position error δ of the target trajectory from the predetermined plasma generation position can be obtained based on the position error δ' of the target trajectory that can be read from the image obtained by the imaging device. However, in the case where the real nozzle position is shifted from the designed nozzle position, it may be difficult to control the droplet target to pass through the predetermined plasma generation position even by moving the nozzle position of the target delivery mechanism to the left in the drawing by the distance δ.

Further, in order to minimize the debris of tin produced after the droplet target is irradiated with the driver laser beam, production of a mass-limited target formed by reducing the diameter of the droplet target (to the diameter of about 10 μm) is proposed. With reduction of the diameter of the droplet target, the control with higher accuracy may be required for the trajectory on which the droplet target passes. As below, "the trajectory on which the droplet target passes" may be simply referred to as "the target trajectory".

In the embodiment, in the EUV light generation chamber apparatus of the LPP light source, the apparatus for measuring and controlling a target trajectory is provided such that stable supply of EUV light can be maintained by adjusting the position or the angle of the target injection nozzle even in the case where the injection direction of the droplet target injected from the target injection nozzle tilts from the predetermined injection direction. A target trajectory measuring unit for measuring the target trajectory may be provided inside or outside of the chamber. However, in the case where there is a possibility that the chamber is thermally deformed, in order to reduce the measurement error, it is desirable that the target trajectory measuring unit is provided outside the chamber and in another frame separate from the chamber.

FIG. 2 is a block diagram showing a configuration example of the apparatus for measuring and controlling a target trajectory according to the one embodiment of the present invention. In the apparatus for measuring and controlling a target trajectory, the nozzle adjustment mechanism 113 adjusts at least one of the position and the angle of the target injection nozzle 103*a*. A target trajectory measuring unit 17 measures the target trajectory 112 formed by the droplet target 109 supplied from the target injection nozzle 103*a* to obtain trajectory information on a target trajectory 112. A target trajectory angle detecting unit 15 obtains a value related to the angle deviation between the target trajectory represented by the trajectory information obtained by the target trajectory measuring unit 17 and the predetermined target trajectory.

A nozzle adjustment controller 18 controls the nozzle adjustment mechanism 113 at least based on the value related to the angle deviation obtained by the target trajectory angle detecting unit 15 such that the droplet target 109 passes through the predetermined laser beam irradiation position 130. Further, the nozzle adjustment controller 18 may control the nozzle adjustment mechanism 113 based on output signals of displacement gauges 21 and 22 such that the position of the target injection nozzle 103*a* coincides with the reference position.

Furthermore, the LPP light source, to which the apparatus for measuring and controlling a target trajectory according to the embodiment is applied, may include a trigger timing adjusting unit 33. To the driver laser 101, the trigger timing adjusting unit 33 sends out a trigger signal for adjusting the trigger timing of the driver laser 101 such that the driver laser 101 irradiates the droplet target 109 with the driver laser beam in the predetermined laser beam irradiation position (plasma generation position) 130 in synchronization with the timing when the droplet target 109 reaches the predetermined laser beam irradiation position 130.

Figure 10:
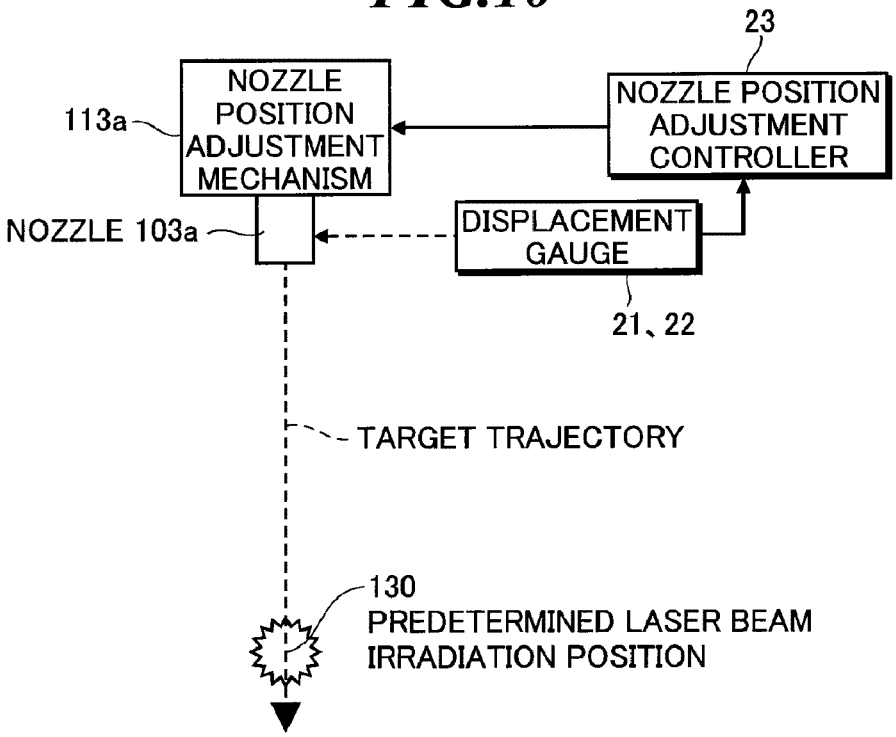
FIG. 10 is a block diagram showing a configuration example of a nozzle position adjustment system in the one embodiment of the present invention.

In the configuration example as shown in FIG. 2, the nozzle adjustment mechanism 113 includes a nozzle position adjustment mechanism 113*a*, and a nozzle angle adjustment mechanism 113*b*. The nozzle position adjustment mechanism 113*a* adjusts the position of the target injection nozzle 103*a*. The nozzle angle adjustment mechanism 113*b* adjusts the angle of the target injection nozzle 103*a*. Further, the nozzle adjustment controller 18 includes a nozzle position adjustment controller 23 and a nozzle angle adjustment controller 16. The nozzle position adjustment controller 23 controls the nozzle position adjustment mechanism 113*a* such that the position of the target injection nozzle 103*a* coincides with the reference position. The nozzle angle adjustment controller 16 controls the nozzle angle adjustment mechanism 113*b* to eliminate the angle deviation obtained by the target trajectory angle detecting unit 15. The apparatus for measuring and controlling a target trajectory includes a target trajectory angle adjustment system as shown in FIG. 3 and a nozzle position adjustment system as shown in FIG. 10.

Figure 3:
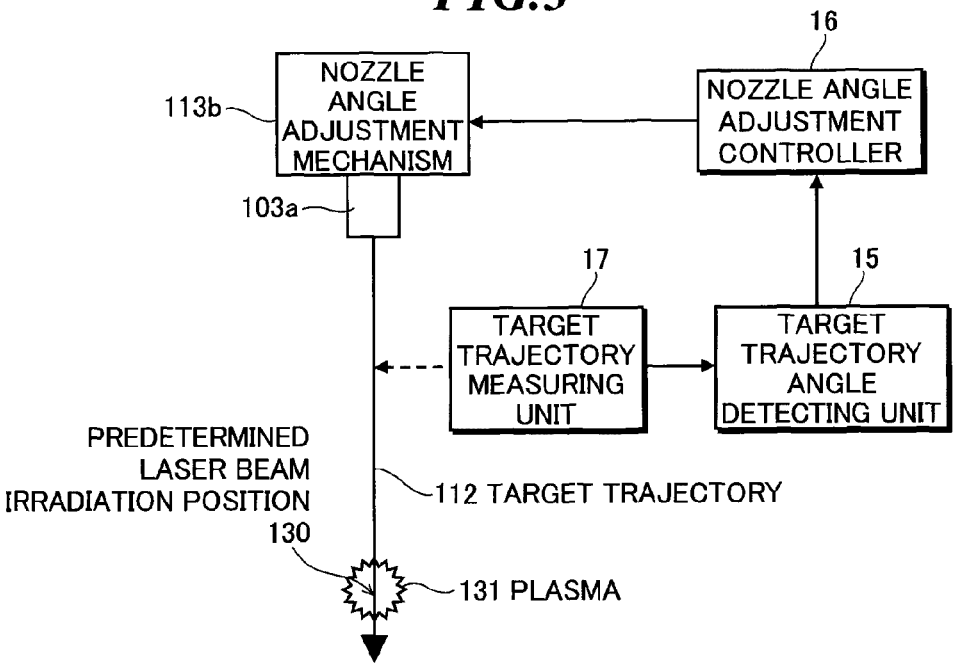
FIG. 3 is a block diagram showing a configuration example of a target trajectory angle adjustment system in the apparatus for measuring and controlling a target trajectory according to the one embodiment of the present invention.

FIG. 3 is a block diagram showing a configuration example of the target trajectory angle adjustment system. The target trajectory angle adjustment system includes the nozzle angle adjustment mechanism 113*b*, the target trajectory measuring unit 17, the target trajectory angle detecting unit 15, and the nozzle angle adjustment controller 16. The nozzle angle adjustment mechanism 113*b* adjusts the angle of the target injection nozzle 103*a*. The target trajectory measuring unit 17 catches the target trajectory 112 formed by the droplet target supplied from the target injection nozzle 103*a* and continuously dropped in the field of view, and measures the target trajectory 112 within a plane substantially orthogonal to the predetermined target trajectory connecting the center of the tip end of the target injection nozzle 103*a* and the predetermined laser beam irradiation position 130, and thereby, obtains the trajectory information on the target trajectory 112. The target trajectory angle detecting unit 15 obtains the value related to the angle deviation (the value representing the angle deviation, or the value proportional to the angle deviation, or the like) between the target trajectory represented by the trajectory information obtained by the target trajectory measuring unit 17 and the predetermined target trajectory, and thereby, detects the tilt of the target trajectory 112. The nozzle angle adjustment controller 16 controls the nozzle angle adjustment mechanism 113*b* to adjust the angle of the target injection nozzle 103*a* so as to reduce the tilt of the target trajectory 112.

Referring to FIG. 2 again, the target trajectory measuring unit 17 may include two-dimensional imaging devices 11 and 13 such as two video cameras or two CCD (charge coupled device) cameras, for example, for respectively obtaining the images of the droplet target 109 in two directions different from each other. In the case where the amount of light is insufficient for imaging the trajectory of the droplet target 109 by using the imaging devices 11 and 13, the object of imaging can be illuminated by using imaging light source devices 12 and 14. Further, in order to catch the trajectory of the droplet target 109 within the two-dimensional plane substantially orthogonal to the predetermined target trajectory, it is desirable that the two imaging devices 11 and 13 are arranged such that their optical axes are orthogonal to each other and the images of the droplet target 109 are respectively obtained in two directions orthogonal to each other.

The nozzle angle adjustment mechanism 113*b* may preferably have a first rotational axis and a second rotational axis orthogonal to each other within the two-dimensional plane substantially orthogonal to the predetermined target trajectory, and can adjust the angle of the target injection nozzle 103*a* by the two rotational axes according to the control signal outputted from the nozzle angle adjustment controller 16. The imaging devices 11 and 13 may be arranged such that the optical axes of the imaging devices 11 and 13 are in parallel to the first and second rotational axes of the nozzle angle adjustment mechanism 113*b*, respectively. In this case, the angle of the target injection nozzle 103*a* can be adjusted by rotating respective one rotational axis with respect to each imaging device.

Figure 4:
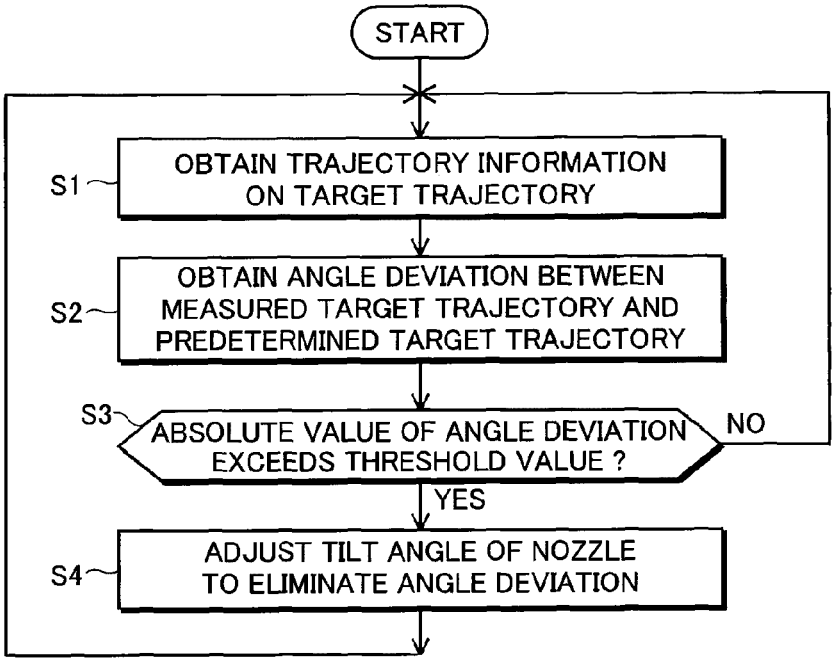
FIG. 4 is a flowchart showing a procedure of target trajectory angle adjustment in the one embodiment of the present invention.

Referring to FIGS. 2 to 6, the operation of the target trajectory angle adjustment system will be explained. FIG. 4 is a flowchart showing a procedure of target trajectory angle adjustment.

First, at step S1 as shown in FIG. 4, the target trajectory measuring unit 17 obtains the trajectory information on the target trajectory 112. The simplest technique is to obtain the trajectory information on the target trajectory 112 based on the image of the target trajectory obtained by using the two-dimensional imaging device such as a video camera or a CCD camera on the assumption that the position of the injection opening of the target injection nozzle 103*a* is not changed.

Figure 5:
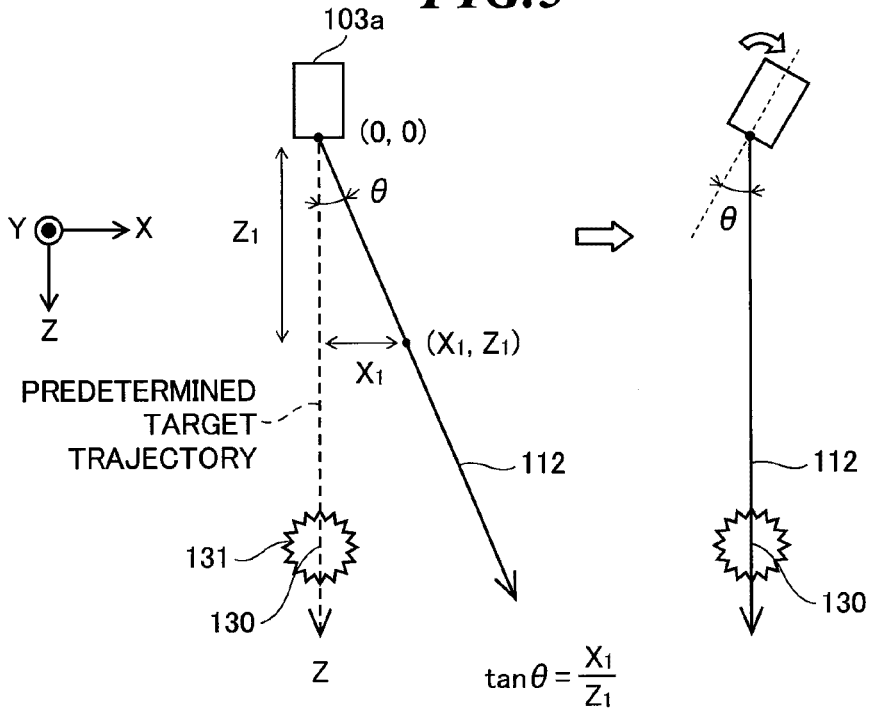
FIG. 5 is a conceptual diagram for explanation of a first technique in a method of measuring and controlling a target trajectory according to one embodiment of the present invention.

FIG. 5 is a conceptual diagram for explanation of a first technique in a method of measuring and controlling a target trajectory according to one embodiment of the present invention. In FIG. 5, a coordinate system is determined in such a manner that the direction from the center of the tip end of the target injection nozzle 103*a* toward the predetermined laser beam irradiation position 130 is set to Z-axis, and X-axis and Y-axis orthogonal to each other are placed on a plane orthogonal to the Z-axis, and the target trajectory 112 observed in the Y-axis direction is shown.

In the left drawing of FIG. 5, assuming that the target injection opening at the center of the tip end of the target injection nozzle 103*a* is set to the origin (0, 0), the target trajectory angle detecting unit 15 obtains the amount of deviation $X_1$ of the target trajectory 112 in the X-axis direction in the measurement position represented by $Z=Z_1$. The amount of deviation $X_1$ represents the distance from the predetermined target trajectory in the X-axis direction. The predetermined target trajectory is a vertical line passing through the predetermined laser beam irradiation position 130, and aligned with the Z-axis (X=Y=0). Therefore, the coordinate of the target trajectory 112 in the measurement position ($Z=Z_1$) is ($X_1$, $Z_1$), and the angle deviation between the measured target trajectory 112 as shown by the solid line in the drawing and the predetermined target trajectory as shown by the broken line in the drawing can be obtained from tan $\theta=X_1/Z_1$.

Even in the case where the target injection nozzle 103*a* and the predetermined laser beam irradiation position 130 are not contained in the images obtained by the imaging devices 11 and 13, if the measurement position ($Z=Z_1$) is determined and the positions of the target trajectory measured in the measurement position ($Z=Z_1$) and the predetermined target trajectory are contained in the images, the angle deviation θ can be obtained by using the amount of deviation $X_2-X_1$ of the target trajectory 112 calculated from the images. At step S2 as shown in FIG. 4, the target trajectory angle detecting unit 15 obtains the angle deviation θ between the measured target trajectory 112 and the predetermined target trajectory in this manner. The angle deviation θ relative to the target trajectory can be obtained from tan $\theta=(X_2-X_1)/(Z_2-Z_1)$.

Then, at step S3 as shown in FIG. 4, the nozzle angle adjustment controller 16 determines whether the absolute value of the angle deviation θ exceeds a predetermined threshold value or not. If the absolute value of the angle deviation θ is small enough and does not exceed the predetermined threshold value (NO at step S3), adjustment of the target trajectory 112 is not necessary, and the process returns to the first step S1. On the other hand, if the absolute value of the angle deviation θ exceeds the predetermined threshold value (YES at step S3), at step S4 as shown in FIG. 4, the nozzle angle adjustment controller 16 controls the nozzle angle adjustment mechanism 113*b* for adjusting the angle of the target injection nozzle 103*a* to adjust the tilt angle of the target injection nozzle 103*a* so as to eliminate the angle deviation θ.

The right drawing of FIG. 5 shows the state after adjustment. Under the condition that the position of the opening of the target injection nozzle 103*a* is fixed to the origin (0, 0), when the target injection nozzle 103*a* is rotated in the opposite direction by the same angle as the absolute value of the angle deviation θ, the target trajectory 112 is aligned with the predetermined target trajectory and the target trajectory 112 passes through the predetermined laser beam irradiation position 130.

By performing the same control as above based on the image obtained in the X-axis direction, the tilt of the target trajectory 112 in the Y-direction can be corrected. In the case of using the first technique as shown in FIG. 5, the predetermined target trajectory can be defined as a vertical line in the image. Therefore, the measured tilt of the target trajectory 112 can be obtained easily from the horizontal distance ($X_1$) of the target trajectory 112 in the measurement position ($Z=Z_1$), and it is not necessary to reflect the origin (0, 0) or the predetermined laser beam irradiation position 130 in the image. Further, it is not necessary to place the measurement position near to the predetermined laser beam irradiation position 130, and thus, the accurate tilt can be obtained without the influence of plasma.

Figure 6:
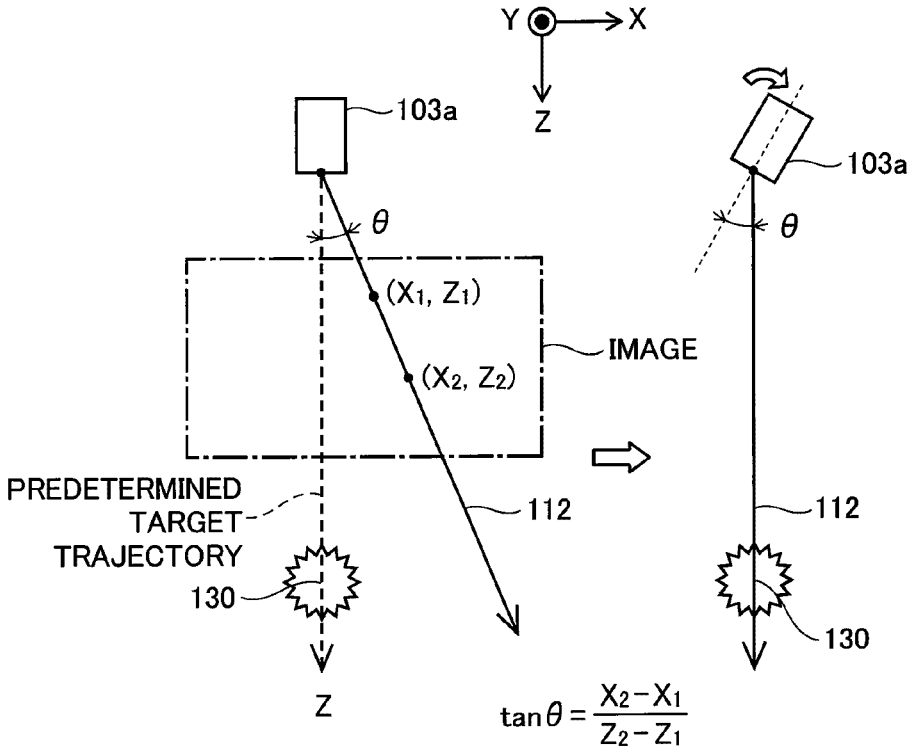
FIG. 6 is a conceptual diagram for explanation of a second technique in the method of measuring and controlling a target trajectory according to the one embodiment of the present invention.

FIG. 6 is a conceptual diagram for explanation of a second technique in the method of measuring and controlling a target trajectory according to the one embodiment of the present invention. In FIG. 6, a coordinate system is determined in such a manner that the direction from the center of the tip end of the target injection nozzle 103*a* toward the predetermined laser beam irradiation position 130 is Z-axis, and X-axis and Y-axis orthogonal to each other are placed on a plane orthogonal to the Z-axis, and the target trajectory observed in the Y-axis direction is shown.

In the left drawing of FIG. 6, the target trajectory angle detecting unit 15 calculates the amounts of deviation $X_1$, $X_2$ of the target trajectory in the X-axis direction in the first measurement position represented by $Z=Z_1$ and the second measurement position represented by $Z=Z_2$, respectively. Thereby, the coordinate ($X_1$, $Z_1$) of the target trajectory 112 in the first measurement position ($Z=Z_1$) and the coordinate ($X_2$, $Z_2$) of the target trajectory 112 in the second measurement position ($Z=Z_2$) are obtained, and the angle deviation θ between the measured target trajectory 112 as shown by the solid line in the drawing and the predetermined target trajectory as shown by the broken line in the drawing can be obtained from tan $\theta=(X_2-X_1)/(Z_2-Z_1)$. The amounts of deviation $X_1$, $X_2$ may not necessarily refer to the Z-axis as long as they are measured based on the reference line in parallel to the Z-axis.

According to the second technique as shown in FIG. 6, the tilt of the target trajectory 112 can be known from the coordinates of arbitrary two points on the target trajectory. If thus obtained absolute value of the angle deviation θ of the target trajectory 112 exceeds a predetermined threshold value, the nozzle angle adjustment controller 16 controls the nozzle angle adjustment mechanism 113*b* to adjust the position of the target injection nozzle 103*a* so as to eliminate the angle deviation θ. As shown in the right drawing of FIG. 6, under the condition that the position of the injection opening of the center of the tip end of the target injection nozzle 103*a* is fixed to the origin (0, 0), when the target injection nozzle 103*a* is rotated around the origin in the opposite direction by the same angle as the absolute value of the angle deviation θ, the target trajectory 112 is aligned with the predetermined target trajectory and the target trajectory 112 passes through the predetermined laser beam irradiation position 130.

In the above configuration, when the angle of the target injection nozzle 103*a* is changed by the nozzle angle adjustment mechanism 113*b*, the position of the injection opening of the tip end of the target injection nozzle 103*a* may move in the horizontal direction in the drawing. In this case, additionally, it may be necessary to compensate for the movement in the horizontal direction in the drawing to maintain the position of the injection opening to the original position by the action of the nozzle position adjustment system or the like. However, even in the case without the control of the nozzle position adjustment controller 23, if the nozzle angle adjustment controller 16 performs the more sophisticated computation to grasp the relationship between the tilt of the target injection nozzle 103*a* and the horizontal movement of the tip end position and controls the nozzle position adjustment mechanism 113*a* together with the nozzle angle adjustment mechanism 113*b*, the injection opening can be held in the original position. Alternatively, a gonio stage tilting around the injection opening position of the center of the tip end of the target injection nozzle 103*a* may be used as the nozzle angle adjustment mechanism 113*b*. The gonio stage is a stage for moving an object along a circumference around a point located in a space.

Figure 7:
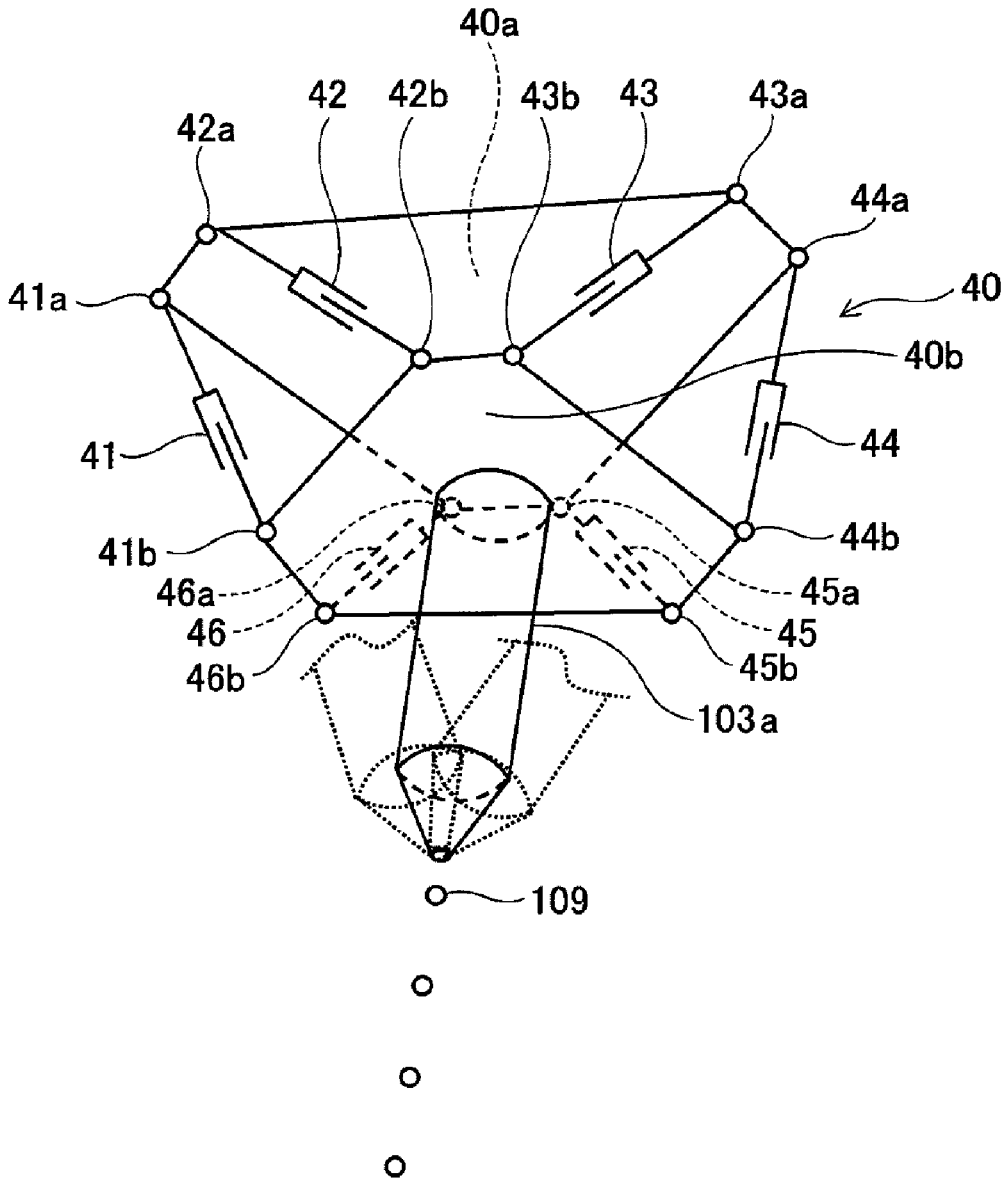
FIG. 7 is a perspective view showing an example of a gonio stage.

FIG. 7 is a perspective view showing an example of the gonio stage. In FIG. 7, a six-axis stage 40 is shown as the example of the gonio stage. The six-axis stage 40 includes six actuators 41-46. One end 41*a* of the actuator 41 is rotatably supported by a reference surface 40*a* (the lower surface of the nozzle position adjustment mechanism 113*a* as shown in FIG. 2), and the other end 41*b* of the actuator 41 is rotatably supported by a movable surface 40*b* to which the target injection nozzle 103*a* is fixed. The other actuators 42-46 are supported similarly to the actuator 41. The nozzle angle adjustment controller 16 as shown in FIG. 2 controls the actuators 41-46, and thereby, the target injection nozzle 103*a* can rotate around the injection opening position of the center of the tip end.

By the way, it is enough that the target trajectory measuring unit 17 as shown in FIG. 2 can measure the distance in the horizontal direction in the drawing, and therefore, as the target trajectory measuring unit 17, one-dimensional sensor such as a line sensor or a position sensitive detector (PSD) may be used in place of the CCD camera or the like for obtaining a two-dimensional image.

Figure 8:
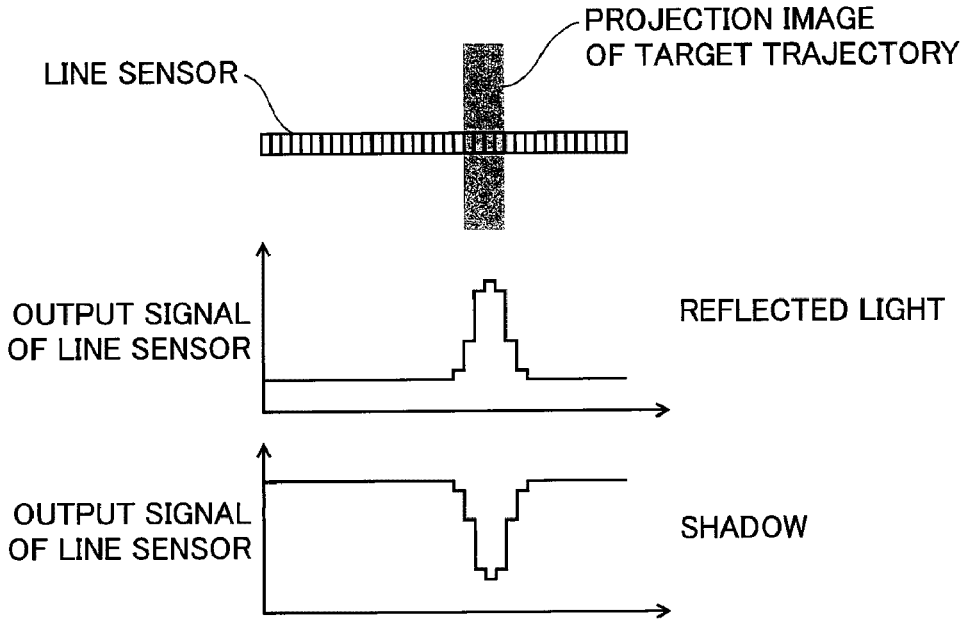
FIG. 8 is a conceptual diagram for explanation of an operation of a line sensor used in a target trajectory measurement unit in the one embodiment of the present invention.

FIG. 8 is a conceptual diagram for explanation of an operation of a line sensor. When an image of the target trajectory is projected on the line sensor via transfer optics, an output signal is generated in a position corresponding to the projection location. The output voltage in the passing position of the droplet target increases when the reflected light reflected on the target trajectory is detected, while the output voltage in the passing position of the droplet target decreases when the shadow of the target trajectory is detected. Therefore, the position of the target trajectory can be sensed based on the output signal that changes in such a manner. The CCD line sensor can measure the position of the target trajectory at the higher speed than that of the imaging device for obtaining a two-dimensional image. In the case where the position of the target trajectory is measured by using plural CCD line sensors, at least two CCD line sensors may be provided in at least two locations along the target trajectory, respectively.

Figure 9:
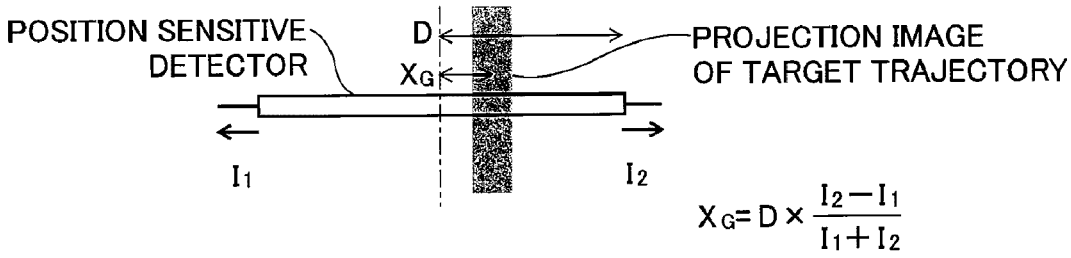
FIG. 9 is a conceptual diagram for explanation of an operation of a position sensitive detector used in the target trajectory measurement unit in the one embodiment of the present invention.

FIG. 9 is a conceptual diagram for explanation of an operation of a position sensitive detector. The position sensitive detector is a sensor that can obtain the position of the centroid of light volume entering the sensor. As shown in FIG. 9, assuming that the reflected light from the target trajectory enters the position at distance $X_G$ from the center of the sensing portion having a length of 2D and the position becomes the centroid of light volume, the position $X_G$ of the centroid of light volume is obtained from the following equation by using currents $I_1$ and $I_2$ flowing out from the ends of the sensor.

$$X_G = D \times (I_2 - I_1)/(I_1 + I_2)$$

Since the position sensitive detector obtains the position of the light spot by the computation of analog voltages, the position of the target trajectory can be measured at an extremely high speed with high resolving power. In the case where the position of the target trajectory is measured by using plural position sensitive detectors, at least two position sensitive detectors may be provided in at least two locations along the target trajectory, respectively.

Figure 11:
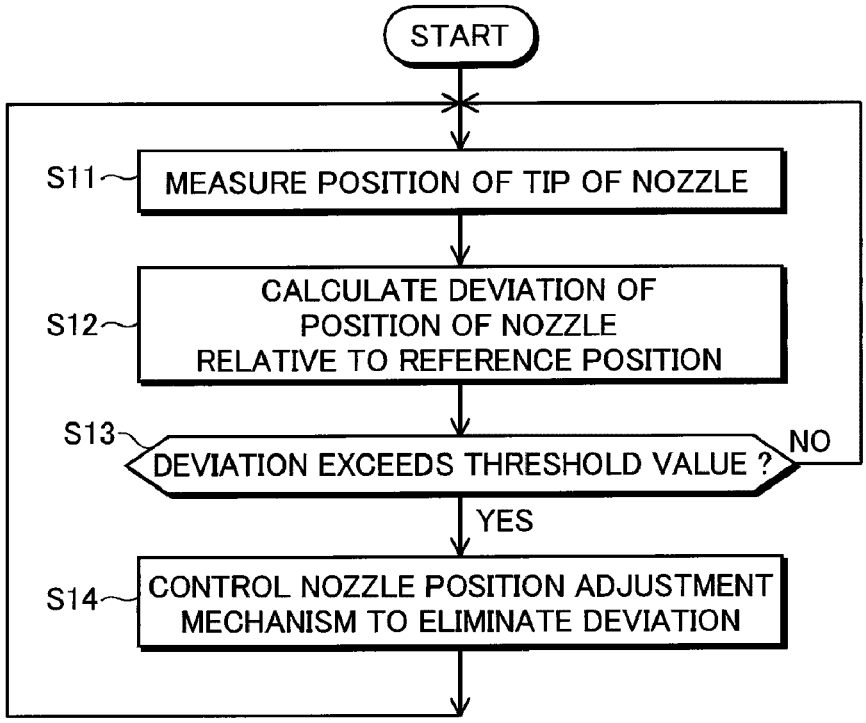
FIG. 11 is a flowchart showing a procedure of nozzle position adjustment in the one embodiment of the present invention.

FIG. 10 is a block diagram showing a configuration example of the nozzle position adjustment system in the one embodiment of the present invention. FIG. 11 is a flowchart showing a procedure of nozzle position adjustment. The nozzle position adjustment system includes the nozzle position adjustment mechanism 113*a*, the two displacement gauges 21 and 22, and the nozzle position adjustment controller 23. The nozzle position adjustment mechanism 113*a* adjusts the position of the target injection nozzle 103*a*. The two displacement gauges 21 and 22 measure the position displacement of the target injection nozzle 103*a*. The nozzle position adjustment controller 23 controls the nozzle position adjustment mechanism 113*a* based on the output signals of the displacement gauges 21 and 22 such that the position of the target injection nozzle 103*a* coincides with the reference position, and thereby, compensates for the position displacement of the target injection nozzle 103*a* in the horizontal direction.

The two displacement gauges 21 and 22 are provided such that their measurement axes are in different directions from each other, and can measure the position of the target injection nozzle 103*a* within the two-dimensional plane orthogonal to the predetermined target trajectory. It is desirable that the optical axes of the two displacement gauges 21 and 22 are orthogonal to each other. As each of the displacement gauges 21 and 22, a laser displacement gauge, a laser interferometer, or the like for performing noncontact and high-accuracy position measurement may be used.

Since the target material is heated to about 300° C., the tip end position of the target injection nozzle 103*a* may be displaced from the original position due to thermal deformation of parts or the like. Even in such a case, in order to supply the target to the predetermined laser beam irradiation position 130, it is preferable that the position of the target injection nozzle 103*a* is measured without the influence of the mechanical displacement due to heat. Accordingly, the nozzle position adjustment system may include the displacement gauges 21 and 22 fixed to an independent frame separated from the mechanical displacement of the target delivery mechanism 103 due to the heat. Thereby, the position of the tip end of the target injection nozzle 103*a* can be measured without the influence of heat (step S11 as shown in FIG. 11).

Further, the nozzle position adjustment controller 23 calculates the deviation of the current position of the target injection nozzle 103*a* relative to the reference position (original position) of the target injection nozzle 103*a* where the droplet target reaches the predetermined laser beam irradiation position 130 (step S12). The nozzle position adjustment controller 23 compares the deviation of the position of the target injection nozzle 103*a* with the predetermined threshold value, and determines whether the deviation exceeds a threshold value or not (step S13). If the deviation does not exceed the predetermined threshold value (NO at step S13), the process returns to the first step S11. On the other hand, if the deviation exceeds the predetermined threshold value (YES at step S13), the nozzle position adjustment controller 23 controls the nozzle position adjustment mechanism 113*a* to move the target injection nozzle 103*a* in a direction in which the deviation is eliminated and they coincide with each other (step S14).

The nozzle position adjustment mechanism 113*a* translates the target injection nozzle 103*a* to adjust the position of the target injection nozzle 103*a*. The nozzle position adjustment mechanism 113*a* may adjust the position of the target injection nozzle 103*a* by moving the target delivery mechanism 103 mounted on a linear stage or the like. In this manner, the position of the target injection nozzle 103*a* is adjusted to coincide with the original position where the droplet target can be supplied to the predetermined laser beam irradiation position 130. The flowcharts as shown in FIGS. 4 and 11 provide an explanation of the algorithm of the control operation using a computer, and further, an explanation of the control principle of an industrial instrument or the like.

By using the nozzle position adjustment system and the target trajectory angle adjustment system in combination and respectively performing feedback control of them, control results with high quality can be obtained. In this case, first, the nozzle position adjustment system may perform control of providing the position of the target injection nozzle 103*a* in the reference position (original position). Then, the target trajectory angle adjustment system may perform control of compensating for the tilt of the target trajectory. Further, two kinds of control may be repeatedly performed. By the separation of the two kinds of control, the target trajectory 112 can be accurately maintained in the predetermined laser beam irradiation position 130.

Further, the target injection nozzle 103*a* may not be tilted. Since the position of the target injection nozzle 103*a* can be measured with relatively high accuracy by the displacement gauges 21 and 22, the target trajectory may be adjusted to pass through the predetermined laser beam irradiation position 130 by only translating the target injection nozzle 103*a*.

Figure 12:
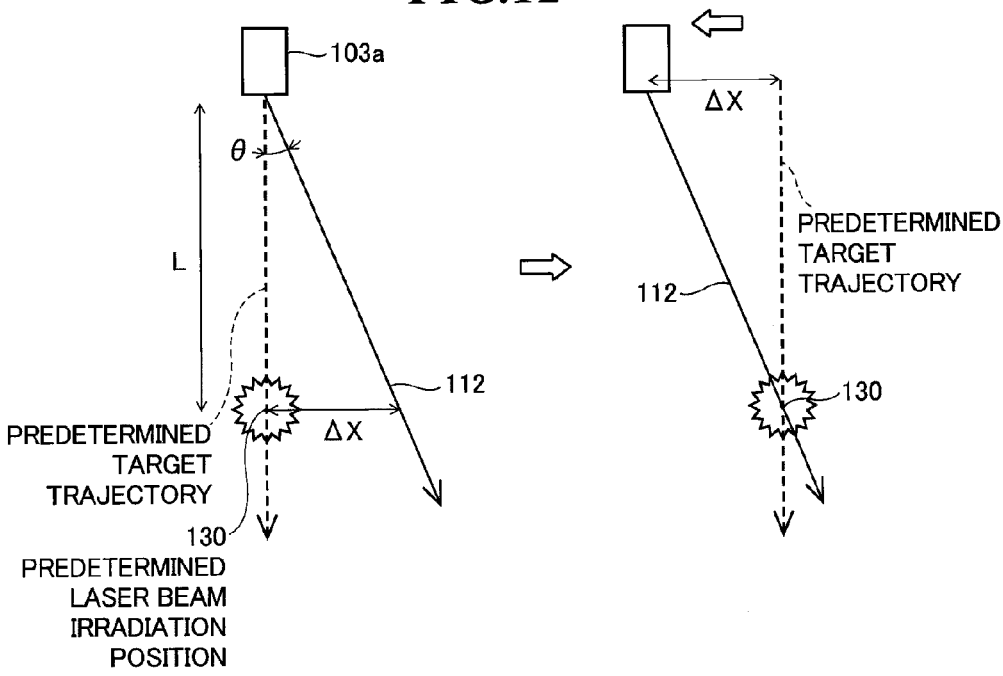
FIG. 12 is a conceptual diagram for explanation of a technique of measuring and controlling a target trajectory by nozzle position adjustment in the one embodiment of the present invention.

FIG. 12 is a conceptual diagram for explanation of a technique of measuring and controlling a target trajectory by nozzle position adjustment in the one embodiment of the present invention. FIG. 12 conceptually shows that, when the target trajectory 112 tilts, the target trajectory 112 is adjusted to be coincident with the predetermined laser beam irradiation position 130 by the translation operation of the target injection nozzle 103*a*.

If the angle deviation θ of the target trajectory 112 from the predetermined target trajectory has been obtained by the target trajectory angle detecting unit 15 (FIG. 2), the droplet target can be supplied to the predetermined laser beam irradiation position 130 by accurately moving the target injection nozzle 103*a* by the horizontal distance deviation ΔX obtained from the computation by the nozzle position adjustment system. That is, when the target trajectory 112 tilts by the angle deviation θ relative to the predetermined target trajectory and around the reference position of the target injection nozzle 103*a*, given that the distance in the Z-axis direction from the center of the tip end of the target injection nozzle 103*a* to the predetermined laser beam irradiation position 130 is L, the distance deviation ΔX in the X-axis direction is L·tan θ. Accordingly, the nozzle position adjustment controller 23 controls the nozzle position adjustment mechanism 113*a* to move the target injection nozzle 103*a* in the opposite direction of the tilt by the distance deviation $\Delta X = L \cdot \tan\theta$, and thereby, the target trajectory 112 may be allowed to pass through the predetermined laser beam irradiation position 130.

Referring to FIG. 2 again, in order to accurately irradiate the droplet target 109 passing through the predetermined laser beam irradiation position 130 at a high speed with the driver laser beam to turn the droplet target 109 into plasma, the extreme ultraviolet light source apparatus may further includes a trigger timing adjustment system for adjusting the trigger timing of the driver laser 101.

The trigger timing adjustment system may include a detector laser 31, a light receiving element 32, and a trigger timing adjusting unit 33. The detector laser 31 applies a detector laser beam 35 for search toward the trajectory of the droplet target 109. The light receiving element 32 detects the detector laser beam 35 passing between the droplet targets or the detector laser beam 35 reflected by the droplet target. The trigger timing adjusting unit 33 senses the timing when the droplet target 109 passes through the predetermined laser beam irradiation position 130 based on the detection signal supplied from the light receiving element 32. Further, the trigger timing adjusting unit 33 generates a trigger signal for adjusting the trigger timing of the driver laser 101 such that the driver laser 101 irradiates the droplet target 109 with a driver laser beam 120 in the predetermined laser beam irradiation position 130, and outputs the trigger signal to the driver laser 101. The driver laser 101 may generate the driver laser beam 120 in synchronization with the trigger signal.

In the case where the scattering light by the driver laser beam 120 is relatively strong or the case where the droplet target is small, the transmitted light or the reflected light of the detector laser beam 35 is relatively weak and the light receiving element 32 may not accurately detect the detector laser beam 35. In such a case, the detector laser beam 35 may be applied toward the position above the predetermined laser beam irradiation position 130 (toward the target injection nozzle 103*a* side) instead of the vicinity of the predetermined laser beam irradiation position 130. The trigger timing adjusting unit 33 senses the timing when the droplet target passes through the detection position, and then, the trigger timing adjusting unit 33 may activate the trigger signal to be supplied to the driver laser 101 with the timing when the droplet target reaches the predetermined laser beam irradiation position 130. Thereby, even the small droplet target 109 is irradiated with the driver laser beam 120, and the droplet target 109 is turned into plasma.

Figure 13:
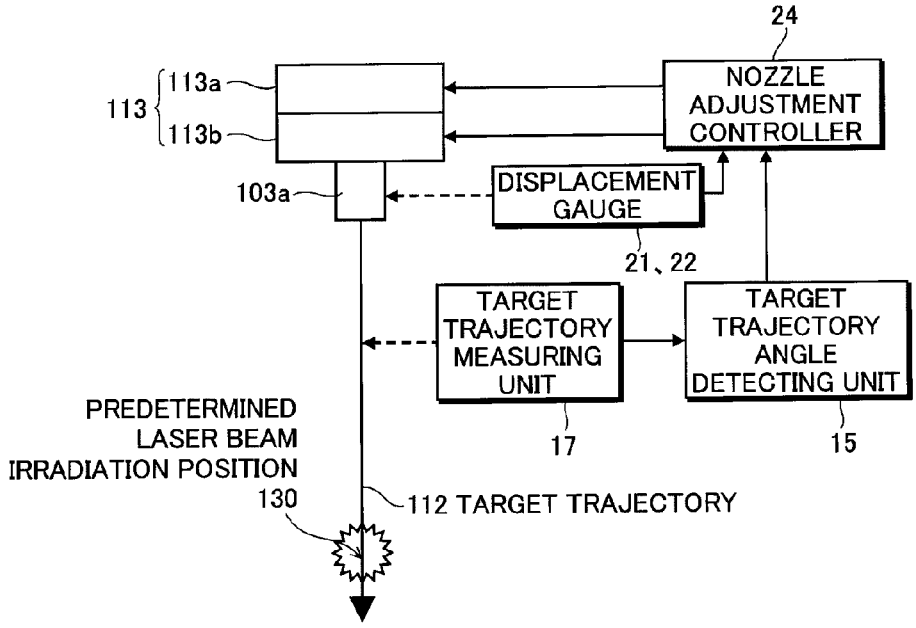
FIG. 13 is a block diagram showing a second mode of the nozzle position adjustment system and the target trajectory angle adjustment system in the one embodiment of the present invention.
Figure 14:
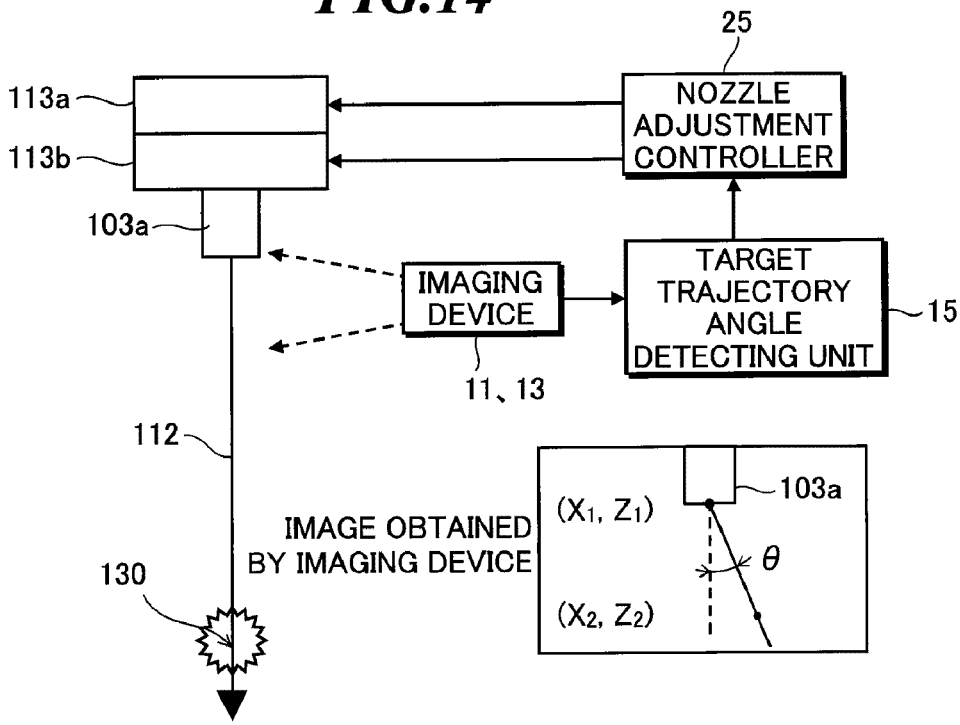
FIG. 14 is a block diagram showing a third mode of the nozzle position adjustment system and the target trajectory angle adjustment system in the one embodiment of the present invention.
Figure 15:
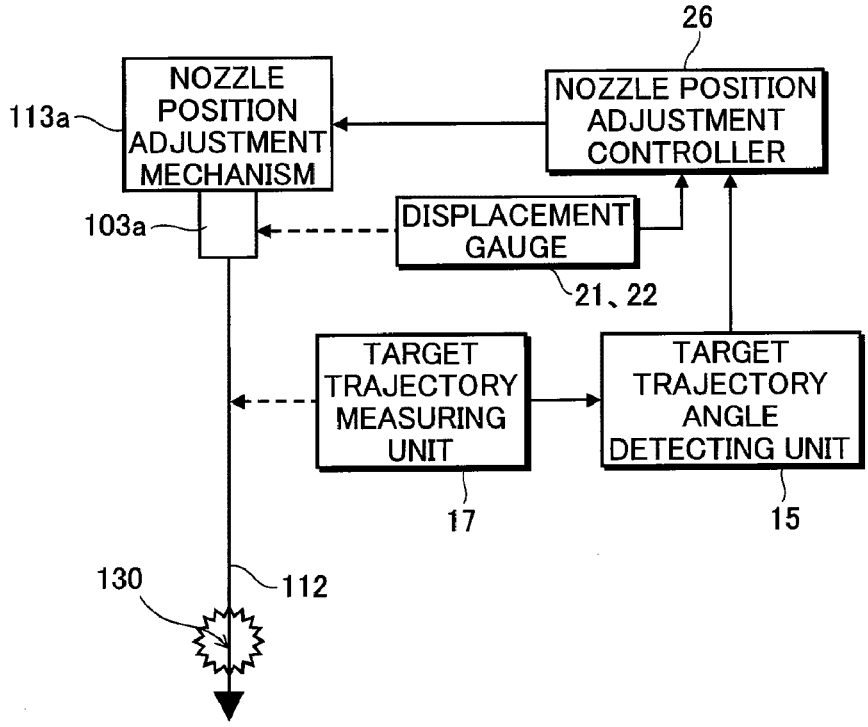
FIG. 15 is a block diagram showing a fourth mode of the nozzle position adjustment system and the target trajectory angle adjustment system in the one embodiment of the present invention.

FIGS. 13-15 are block diagrams showing some modes of the nozzle position adjustment system and the target trajectory angle adjustment system.

FIG. 13 is a block diagram showing a second mode of the nozzle position adjustment system and the target trajectory angle adjustment system in the one embodiment of the present invention. FIG. 13 shows the nozzle position adjustment system and the target trajectory angle adjustment system for measuring the position displacement of the target injection nozzle 103*a* and the tilt of the target trajectory 112 and eliminating the respective deviations.

The nozzle position adjustment system and the target trajectory angle adjustment system include the nozzle position adjustment mechanism 113*a*, the nozzle angle adjustment mechanism 113*b*, the target trajectory measuring unit 17, the target trajectory angle detecting unit 15, the displacement gauges 21 and 22, and a nozzle adjustment controller 24. The nozzle position adjustment mechanism 113*a* adjusts the position of the target injection nozzle 103*a*. The nozzle angle adjustment mechanism 113*b* adjusts the angle of the target injection nozzle 103*a*. The target trajectory measuring unit 17 measures the target trajectory by using a sensor selected from among various sensors cited above. The target trajectory angle detecting unit 15 obtains the value related to the angle deviation between the target trajectory represented by the trajectory information and the predetermined target trajectory based on the trajectory information obtained by the target trajectory measuring unit 17, and thereby, detects the tilt of the target trajectory 112. The displacement gauges 21 and 22 measure the position displacement of the tip end of the target injection nozzle 103*a*. The nozzle adjustment controller 24 controls the nozzle position adjustment mechanism 113*a* and the nozzle angle adjustment mechanism 113*b* to respectively perform the position adjustment of the target injection nozzle 103*a* and the angle adjustment of the target trajectory based on the output signals of the displacement gauges 21 and 22 and the value related to the angle deviation obtained by the target trajectory angle detecting unit 15.

In the nozzle position adjustment system and the target trajectory angle adjustment system, the displacement gauges 21 and 22 directly measure the displacement of the tip end of the target injection nozzle 103*a*, and the nozzle adjustment controller 24 generates the control signal of the nozzle position adjustment mechanism 113*a* and the control signal of the nozzle angle adjustment mechanism 113*b* based on the measurement result and the information on the tilt of the target trajectory 112. For example, the nozzle adjustment controller 24 may first perform control of providing the position of the target injection nozzle 103*a* in the reference position, and then, perform control of compensating for the tilt of the target trajectory. Further, the nozzle adjustment controller 24 may repeatedly perform the two kinds of control. Thereby, the target trajectory 112 can be accurately controlled to pass through the predetermined laser beam irradiation position 130. According to the mode, high-accuracy control can be performed compared to the mode of adjusting the horizontal position of the target injection nozzle 103*a* according to the position error of the target trajectory 112.

FIG. 14 is a block diagram showing a third mode of the nozzle position adjustment system and the target trajectory angle adjustment system in the one embodiment of the present invention. As shown in the image example on the lower right of FIG. 14, the tip end portion of the target injection nozzle 103*a* is reflected in the images obtained by the imaging devices 11 and 13, and thus, without using the displacement gauges 21 and 22, the coordinate $(X_1, Z_1)$ of the center of the tip end of the target injection nozzle 103*a* as the reference point and the coordinate $(X_2, Z_2)$ of the target trajectory in the measurement position represented by $Z=Z_2$ can be obtained. The target trajectory angle detecting unit 15 obtains the angle deviation θ of the target trajectory 112 from the two coordinates, and obtains the position displacement of the target injection nozzle 103*a* from the coordinate of the tip end of the target injection nozzle 103*a*. It is preferable that the imaging devices 11 and 13 are at the same distance from the tip end of the target injection nozzle 103*a* and have the same angle of view.

On the basis of the information, a nozzle adjustment controller 25 controls the nozzle position adjustment mechanism 113*a*. The nozzle adjustment controller 25 further maintains the tip end of the target injection nozzle 103*a* in the original position and controls the nozzle angle adjustment mechanism 113*b*. Thereby, the nozzle adjustment controller 25 compensates for the tilt of the target injection nozzle 103*a* and maintains the target trajectory 112 of the droplet target injected from the target injection nozzle 103*a* in the Z-axis direction. Accordingly, the target trajectory 112 of the target injected from the target injection nozzle 103*a* can pass through the predetermined laser beam irradiation position 130. In the third mode as shown in FIG. 14, the target injection nozzle 103*a* is included in the field of view of the imaging devices 11 and 13 and the displacement gauges 21 and 22 are omitted, and there is an advantage that the apparatus is simplified compared to the second mode as shown in FIG. 13.

FIG. 15 is a block diagram showing a fourth mode of the nozzle position adjustment system and the target trajectory angle adjustment system in the one embodiment of the present invention. In the fourth mode, the nozzle angle adjustment mechanism 113*b* is omitted in the second mode as shown in FIG. 13, and there is an advantage that the nozzle adjustment mechanism is simplified.

The nozzle position adjustment system and the target trajectory angle adjustment system as shown in FIG. 15 include the nozzle position adjustment mechanism 113*a*, the target trajectory measuring unit 17, the target trajectory angle detecting unit 15, the displacement gauges 21 and 22, and a nozzle position adjustment controller 26. The nozzle position adjustment mechanism 113*a* adjusts the position of the target injection nozzle 103*a*. The target trajectory measuring unit 17 measures the target trajectory by using a sensor selected from among various sensors cited above. The target trajectory angle detecting unit 15 obtains the value related to the angle deviation between the target trajectory represented by the trajectory information obtained by the target trajectory measuring unit 17 and the predetermined target trajectory, and thereby, detects the tilt of the target trajectory 112. The displacement gauges 21 and 22 measure the position displacement of the tip end of the target injection nozzle 103*a*. The nozzle position adjustment controller 26 controls the nozzle position adjustment mechanism 113*a* to perform the position adjustment of the target injection nozzle 103*a* based on the output signals of the displacement gauges 21 and 22 and the value related to the angle deviation obtained by the target trajectory angle detecting unit 15.

The nozzle position adjustment controller 26 controls the nozzle position adjustment mechanism 113*a* based on the position deviation of the target injection nozzle 103*a* and the measured tilt of the target trajectory 112. Thereby, the target injection nozzle 103*a* can be translated such that the target trajectory 112 passes through the predetermined laser beam irradiation position 130.

According to the one embodiment of the invention, in the chamber apparatus of the LPP light source, even in the case where the injection direction of the droplet target injected from the target injection nozzle of the target delivery mechanism tilts from the predetermined injection direction, the angle deviation between the measured target trajectory and the predetermined target trajectory can be obtained and at least one of the position and the angle of the target injection nozzle can be adjusted based on the angle deviation such that the droplet target passes through the predetermined position.

Furthermore, according to some embodiments, the following merits may be obtained.

(1) The LPP type EUV light source apparatus may generate EUV light constantly with high efficiency.

(2) Since it is highly possible that the laser beam can be focused and applied to the center part of the droplet target with high accuracy, the intensity distribution may be more uniform in a far field (a region farther from the plasma generation position (emission point of EUV light) than the intermediate focusing point (IF)), and the energy stability of EUV light may be improved.

(3) Even in the case where the diameter of the droplet target is made smaller, it is possible that the droplet target can be irradiated with the laser beam with high accuracy, and the debris may be reduced.

In addition, in the above described embodiment, the case where the present invention is applied to the LPP type EUV light source apparatus for generating EUV light by focusing the driver laser beam to the predetermined laser beam irradiation position, where the droplet target passes, to generate plasma has been explained, but the present invention is not limited to the embodiment. For example, the present invention can be also applied to an LPP type EUV light source apparatus for generating EUV light by irradiating the droplet target with a pre-pulse laser beam for expanding the target or weakly turning it into plasma, and then, irradiating the expanded target or the weak plasma with a main-pulse laser beam to generate plasma.

The invention claimed is:

1. An apparatus for measuring and controlling a target trajectory within a chamber apparatus for generating extreme ultraviolet light from plasma generated by irradiating a droplet target supplied from a target injection nozzle with a driver laser beam from an external driver laser, said apparatus comprising:

a nozzle adjustment mechanism for adjusting a position and particular angles of said target injection nozzle, wherein said nozzle adjustment mechanism is configured to adjust a first angle of said target injection nozzle around a first rotational axis and to adjust a second angle of said target injection nozzle around a second rotational axis orthogonal to the first rotational axis;

a target trajectory measuring unit for measuring a target trajectory formed by a droplet target supplied from said target injection nozzle to obtain trajectory information on the target trajectory;

a target trajectory angle detecting unit for obtaining an angle deviation between the target trajectory represented by the trajectory information obtained by said target trajectory measuring unit and a predetermined target trajectory; and a nozzle adjustment controller for controlling said nozzle adjustment mechanism based on the angle deviation obtained by said target trajectory angle detecting unit such that the droplet target supplied from said target injection nozzle passes through a predetermined position.

2. The apparatus according to claim 1, further comprising:

a displacement gauge for measuring position displacement of said target injection nozzle;

wherein said nozzle adjustment controller controls said nozzle adjustment mechanism based on an output signal of said displacement gauge such that the position of said target injection nozzle coincides with a reference position.

3. The apparatus according to claim 1, wherein:

said target trajectory measuring unit measures a position of a center of a tip end of said target injection nozzle and the target trajectory to obtain the trajectory information on the target trajectory; and said target trajectory angle detecting unit obtains the angle deviation between the target trajectory represented by the trajectory information obtained by said target trajectory measuring unit and the predetermined target trajectory with the measured position of the center of the tip end of said target injection nozzle as a reference point.

4. The apparatus according to claim 1, wherein:

said nozzle adjustment mechanism includes a nozzle position adjustment mechanism for adjusting the position of said target injection nozzle, and a nozzle angle adjustment mechanism for adjusting the particular angles of said target injection nozzle; and said nozzle adjustment controller controls said nozzle position adjustment mechanism and said nozzle angle adjustment mechanism to eliminate the angle deviation obtained by said target trajectory angle detecting unit.

5. The apparatus according to claim 1, wherein:

said nozzle adjustment mechanism includes a nozzle position adjustment mechanism for adjusting the position of said target injection nozzle, and a nozzle angle adjustment mechanism for adjusting the particular angles of said target injection nozzle; and said nozzle adjustment controller controls said nozzle position adjustment mechanism such that the position of said target injection nozzle coincides with a reference position, and controls said nozzle angle adjustment mechanism to eliminate the angle deviation obtained by said target trajectory angle detecting unit.

6. The apparatus according to claim 1, further comprising:

a detector laser for irradiating the droplet target supplied from said target injection nozzle with a detector laser beam;

a light receiving element for detecting one of the detector laser beam passing between the droplet targets and the detector laser beam reflected by the droplet target; and a trigger timing adjusting unit for sensing timing when the droplet target passes through the predetermined position based on a detection signal supplied from said light receiving element, and sending out a trigger signal for adjusting trigger timing of said driver laser to said driver laser.

7. The apparatus according to claim 1, wherein said target trajectory measuring unit includes at least two imaging devices, and obtains images of the droplet target at least in two directions to obtain the trajectory information on the target trajectory.

8. The apparatus according to claim 7, wherein said two imaging devices obtain images of the droplet target in two directions orthogonal to each other.

9. The apparatus according to claim 8, wherein said two imaging devices obtain images of the droplet target in two directions in parallel to said first and second rotational axes, respectively.

10. The apparatus according to claim 1, wherein said target trajectory measuring unit includes a one-dimensional line sensor.

11. The apparatus according to claim 10, wherein said target trajectory measuring unit includes at least two one-dimensional line sensors, and measures the position of the target trajectory at least in two locations along the target trajectory.

12. The apparatus according to claim 1, wherein said target trajectory measuring unit includes a position sensitive detector.

13. The apparatus according to claim 12, wherein said target trajectory measuring unit includes at least two position sensitive detectors, and measures the position of the target trajectory at least in two locations along the target trajectory.

14. The apparatus according to claim 7, wherein said target trajectory measuring unit includes an imaging light source for illuminating an object of imaging.

15. A method of measuring and controlling a target trajectory within a chamber apparatus for generating extreme ultraviolet light from plasma generated by irradiating a droplet target supplied from a target injection nozzle with a driver laser beam from an external driver laser, said method comprising the steps of:

(a) measuring a target trajectory formed by a droplet target supplied from said target injection nozzle to obtain trajectory information on the target trajectory;

(b) obtaining an angle deviation between the target trajectory represented by the trajectory information obtained at step (a) and a predetermined target trajectory; and (c) adjusting a position and particular angles of said target injection nozzle based on the angle deviation obtained at step (b) such that the droplet target supplied from said target injection nozzle passes through a predetermined position, wherein a first angle of said target injection nozzle is adjusted around a first rotational axis and a second angle of said target injection nozzle is adjusted around a second rotational axis orthogonal to the first rotational axis.

16. The apparatus according to claim 1, wherein said target trajectory measuring unit is provided in a second frame separate from a first frame provided with said chamber apparatus.

17. An apparatus for measuring and controlling a target trajectory within a chamber apparatus for generating extreme ultraviolet light from plasma generated by irradiating a droplet target supplied from a target injection nozzle with a driver laser beam from an external driver laser, said apparatus comprising:

a nozzle adjustment mechanism for adjusting at least one of a position and an angle of said target injection nozzle wherein said nozzle adjustment mechanism is configured to adjust a first angle of said target injection nozzle around a first rotational axis and to adjust a second angle of said target injection nozzle around a second rotational axis orthogonal to the first rotational axis;

a target trajectory measuring unit for measuring a target trajectory formed by a droplet target supplied from said target injection nozzle to obtain trajectory information on the target trajectory;

an imaging device for obtaining images of a tip end of said target injection nozzle;

a target trajectory angle detecting unit for obtaining an angle deviation between the target trajectory and the predetermined target trajectory based on the trajectory information obtained by said target trajectory measuring unit and the images obtained by said imaging device; and a nozzle adjustment controller for controlling said nozzle adjustment mechanism based on the angle deviation obtained by said target trajectory angle detecting unit such that the droplet target passes through a predetermined position.

* * * * *